US005435743A

United States Patent [19]

Farah

[11] Patent Number: 5,435,743

[45] Date of Patent: Jul. 25, 1995

[54] CASING FOR ASSURING AN ELECTRICAL CONNECTION

[75] Inventor: Jose L. Farah, Oak Park, Mich.

[73] Assignee: Chrysler Corporation, Highland Park, Mich.

[21] Appl. No.: 214,275

[22] Filed: Mar. 17, 1994

[51] Int. Cl.[6] ..... H01R 13/627

[52] U.S. Cl. ..... 439/352; 439/274

[58] Field of Search ..... 439/350, 351, 352, 353, 439/354, 357, 358, 701, 274, 275, 587, 686, 271

[56] References Cited

U.S. PATENT DOCUMENTS

| | | | |
|---|---|---|---|
| 3,701,071 | 10/1972 | Landman . | |
| 4,311,355 | 1/1982 | Plyler et al. | 439/274 |
| 4,412,714 | 11/1983 | Morningstar et al. | 439/352 |
| 4,475,785 | 10/1984 | Mueller et al. . | |
| 4,647,726 | 3/1987 | Blum | 379/438 |
| 4,884,978 | 12/1989 | Inaba et al. | 439/352 |
| 4,998,896 | 3/1991 | Lundergan | 439/274 |
| 5,017,147 | 5/1991 | Sugiyama et al. | 439/144 |
| 5,092,788 | 3/1992 | Pristupa, Jr. et al. | 439/225 |

FOREIGN PATENT DOCUMENTS 3634695 4/1988 Germany .

*Primary Examiner*—Gary F. Paumen
*Assistant Examiner*—Hien D. Vu
*Attorney, Agent, or Firm*—Wendell K. Fredericks

[57] ABSTRACT

A security casing for an electrical connection wherein the security casing has an end wall for engaging a resilient seal in the connector, a pair of longitudinally extending side walls with slots therein and opposed top and bottom walls with a latching flap pivoted to the top wall by a living hinge. The casing overlies one connector member which has a pair of laterally projecting detents and a spring arm with a slot for receiving a detent of a mating connector member. The latching flap has detents thereon which snap into latching engagement with the spring arm to hold the casing in position. The casing ensures that a resilient seal within the connector member does not blow out and helps ensure that the electrical connection is retained.

10 Claims, 2 Drawing Sheets

CASING FOR ASSURING AN ELECTRICAL CONNECTION

1. Field of the Invention

The present invention relates to casings for assuring an electrical connections. More particularly, the present invention relates to an approach for assuring electrical connections by latching a casing thereover.

2. Background of the Invention

Automotive vehicles increasingly rely on electronic and electrical devices for controlling practically every aspect of their operation. These components are connected to the vehicle's electrical system by electrical connectors which facilitate rapid assembly of the vehicle and permit components to be rapidly and easily replaced when defective. Electrical connectors also permit components to be isolated for testing. In that electrical connectors are separable, they can be a source of trouble due to breakage, assembly faults, and environmental degradation. Electrical connectors in the engine compartment of an automobile are subject to vibration, heat, cold and moisture. Accordingly, the connectors must be relatively robust and include seals to keep moisture and debris away from abutting contacts.

Ordinarily, male and female connectors which comprise an electrical connector have structure unitary or integral therewith which lock upon shoving the connectors together. It has been found that from time to time the latching elements do not properly engage. In addition, resilient sealing elements within the connectors from time to time "blow out" of the connectors. Accordingly, there is a need in the automotive industry for devices which assure connector position to ensure that proper electrical connections are made and maintained.

SUMMARY OF THE INVENTION

In view of the aforementioned considerations, it is an object of the present invention to provide a device for assuring electrical connector position in order to ensure that electrical connections are made and maintained.

In view of this object and other objects, the present invention is directed to a casing for assuring an electrical connection between a female electrical connector member and a male electrical connector member which are axially slid into connective engagement with one another. The electrical connector members have laterally extending detents with the male electrical connector member having a cantilevered spring arm with a longitudinally extending slot for receiving a detent on the female member. The casing comprises an end wall with an opening therein for alignment with an axially compressible seal having lead holes therethrough positioned at one end of the male member. The opening has an area smaller than the lateral area of the seal and is aligned with the holes through the seal. A pair of resilient side walls, integral with the end wall, have longitudinally extending slots for receiving detents on the male connector member to secure the casing to the male connector member. A stiffened top wall is integral with the front wall and extends transversely with respect to the side walls, the top wall being positioned to engage the spring arm of the male member. A latching flap is connected to the top wall by a living hinge, the latching flap having detents for latchably engaging the spring arm on the male member to further secure the casing to the male member.

In another aspect, the present invention further contemplates the combination of a female connector member and a male connector member enclosed in a casing. The male connector member has a pair of laterally projecting detents extending in opposite directions substantially normal to the detent on the female member and a cantilevered spring arm extending longitudinally having a slot therein for receiving a laterally extending detent on the female member. The casing has an end wall with an opening therethrough which is axially alignable with a resilient seal in the male member and a pair of opposed spring arm side walls with slots therein for receiving lateral detents of the male member. Extending from the male member is a latching flap having detents thereon for latchably engaging the spring arm of the male member.

Upon further study of the specification and appended claims, further objects and advantages of this invention will become apparent to those skilled in the art.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
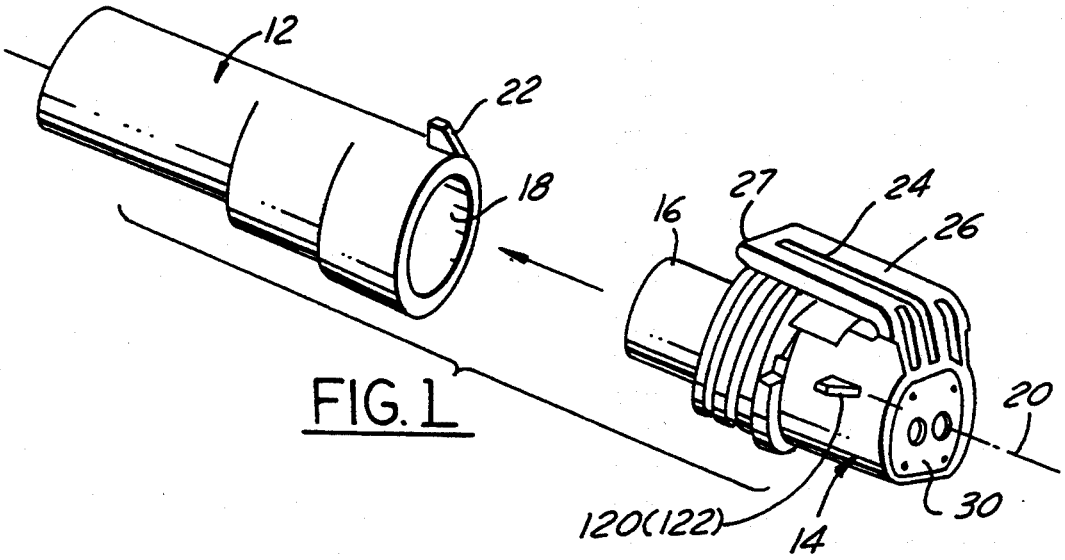
FIG. 1 is a perspective view showing male and female connector members detached from one another.

Referring now to FIG. 1, there is shown a female electrical connector member 12 and male electrical connector member 14. The male member 14 is configured with an axial projection 16 which is slid longitudinally into an axial recess 18 in the female connector member 12 along a longitudinal axis 20. The female connector member 12 has a projecting detent 22 which is received within a slot 24 on a cantilevered, split spring arm 26 depending from and longitudinally extending substantially parallel to the extent of the male connector member 14. The spring arm 26 terminates with a free end 27 overlying in spaced relation a circular seal 29 disposed around a back portion of the projection 16. The female connector member 12 and male connector member 14 are of a configuration which is becoming widely used in the automotive industry to connect electrical leads (not shown). In that automotive vehicles increasingly rely on the transmission of electrical signals for the operation of engines and accessories, it is very important that once the female and male connector members 12 and 14 are connected (1 as is shown in FIG. 2) that the connection is maintained.

Figure 2:
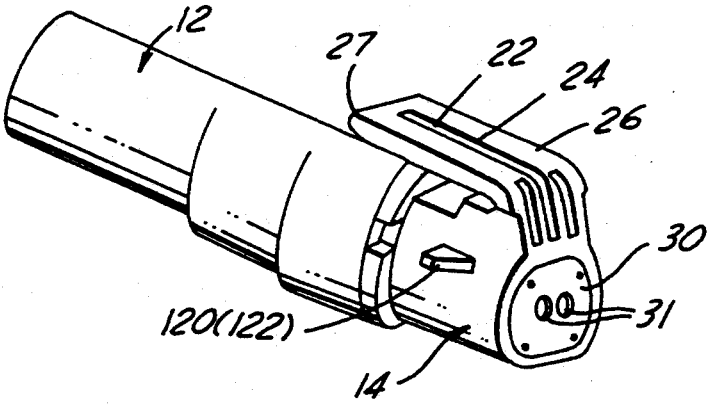
FIG. 2 is a perspective view showing male and female connector members of FIG. 1 connected with the male member have a projection inserted into a recess in the female member.

Referring now to FIG. 2, where the connector members 12 and 14 are joined, it is seen that the split spring arm 26 defining the slot 24 receives the detent 22 of the female connector 12 so as to maintain the connection. Internal arrangements, not part of this invention, ensure that the projection 16 on the male member 14 is properly oriented with respect to the recess 18 so that the electrical lines (not shown 1 being connected, are not reversed, thus ensuring that the detent 22 is received in the slot 24, rather than being 180° out of orientation with the slot. While the connection of FIG. 2 is secure, it is necessary and desirable to further assure that the electrical connection is maintained and that a rear seal 30 within the connector 14 does not "blow out" upon effecting the connection.

Figure 3:
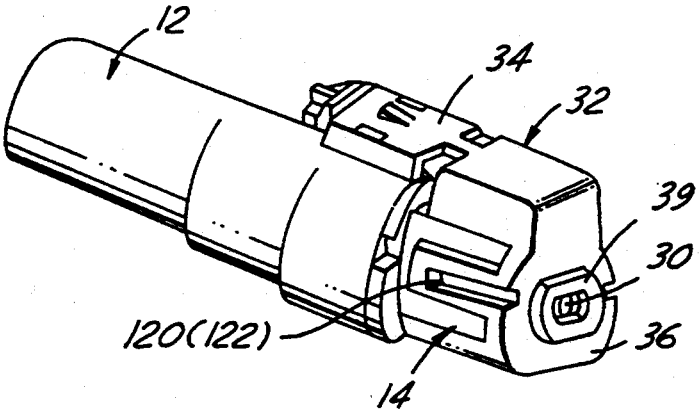
FIG. 3 is a perspective view showing the male and female members connected as in FIG. 2, the connection being assured by an overlying casing configured and used in accordance with the principles of the instant invention.

Referring now to FIG. 3, there is shown a casing 32 which is latched to the male connector member 14. The casing 32 has a latching flap 34 which completely overlies the spring arm 26 and an end wall 36 which overlies the resilient seal 30. The casing 32 provides connector position assurance by ensuring that a connection is made while preventing the rear seal 30 within the male connector member 14 from blowing out. The rear end wall 36 has an opening therethrough of an area less than the area of the resilient seal 30 which opening 38 is surrounded by an axially projecting exterior rim 39 on the outside surface of the rear end wall.

Figure 5:
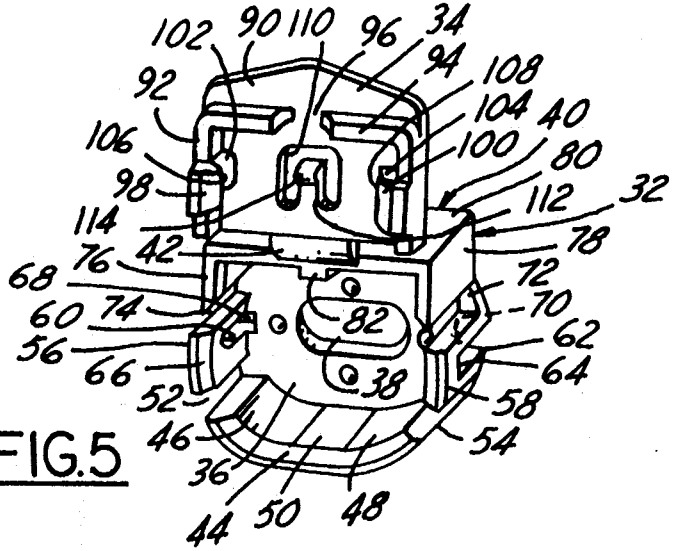
FIG. 5 is a back perspective view of the casing shown in FIG. 4.
Figure 4:
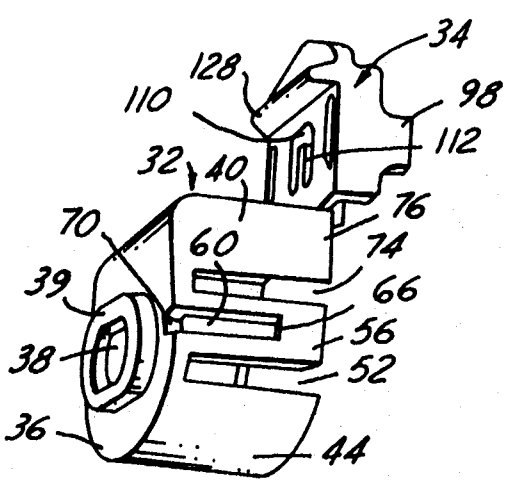
FIG. 4 is a side perspective view of the casing shown in FIG. 3 shown separate from the electrical connection.

Referring now to FIGS. 4 and 5, it is seen that the connector casing 32 is comprised of a body portion 40 to which the latching flap 34 is hinged by a living hinge 42. Preferably, the casing 32 is unitary and is molded of polypropylene.

Extending from the end wall 36 of the casing 32 is a substantially arcuate bottom wall 44 having a pair of arcuate portions 46 and 48 and a flat portion 50 which results in a relatively stiff bottom wall. Separated from the bottom wall 44 by pairs of slots 52 and 54 are side walls 56 and 58, each of which are cantilevered on the back wall 36. The side walls 56 and 58 function as spring arms and include longitudinally extending slots 60 and 62 therein which are closed by end walls 64 and 66. In order to render the slots relatively flexible, they are aligned with short cutouts 68 and 70 in the rear wall 36 of the casing 32.

Disposed above the spring arm side walls 56 and 58 are slots 72 and 74 which are bordered by stiff side walls 76 and 78. The stiff side walls 76 and 78 join the rear end wall 36 and an upper wall 80 to form a U-shaped, relatively rigid structure for supporting the latching flap 34. The top wall 80 has a longitudinally extending rib 82 (which fits in the slot 24 of the cantilevered spring arm 26 shown in FIG. 2).

Figure 8:
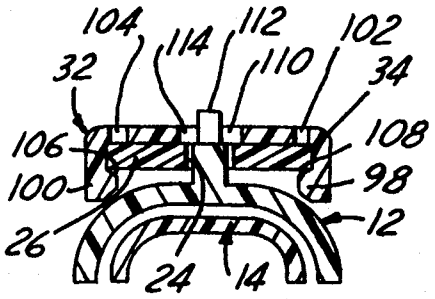
FIG. 8 is an end view of a portion of FIG. 7 showing the casing latched.
Figure 7:
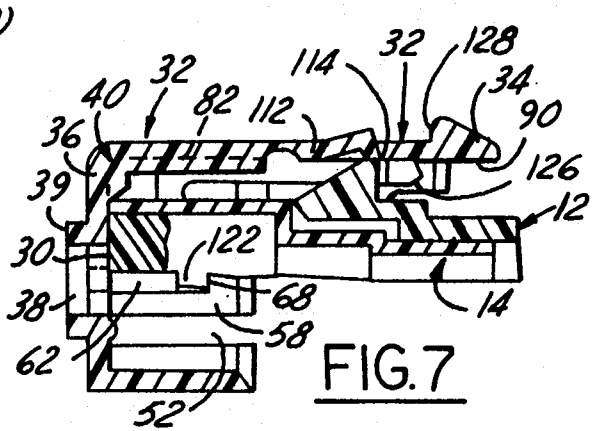
FIG. 7 is a view similar to FIG. 6 but showing the casing fully latched to the connectors.

The flap 34 has a tab portion 90 which projects beyond L-shaped ribs 92 and 94 which are separated by a space 96. The L-shaped ribs 92 and 94 have detents 98 and 100 projecting therefrom, the resiliency of which are enhanced by cutouts 102 and 104, respectively, in the flap 34. Detents 98 and 100 have shoulders 106 and 108 (which as seen in FIGS. 7 and 8 latchably engage the spring arm 26—see FIG. 2). Disposed within the area enclosed by the ribs 92 and 94 is a recess 110 which has a spring finger 112 cantilevered therein. The spring finger 112 has a pawl 114 on the end thereof (for engaging the detent 22 on the female member 12—see FIGS. 1, 2 and 6–8).

Figure 6:
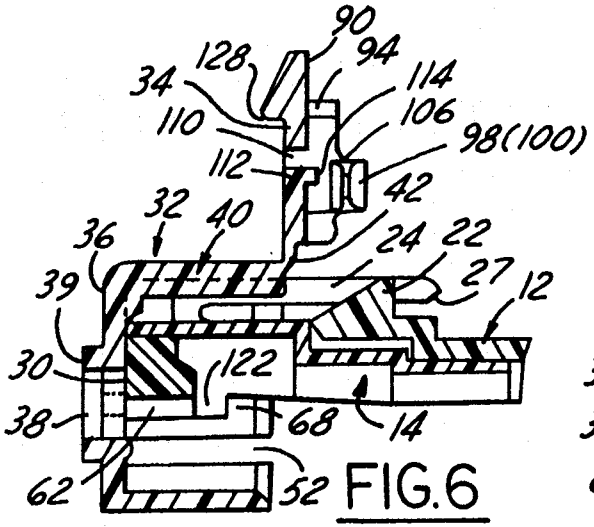
FIG. 6 is a side elevation of the casing shown cooperating with portions of the male and female connectors of FIGS. 1–3 prior to being fully latched.

Referring now to FIGS. 6–8, the casing 32 is shown with the latching flap 34 disengaged (FIG. 6), and engaged (FIGS. 7 and 8). As is seen in FIG. 6, the male connector member 14 has its terminal end pushed against the end wall 36 with the seal 30 engaging the end wall. When the male connector 14 is in this position, detents 120 and 122 (see FIGS. 1–3) on opposite sides of the male contact 14 are engaged within slots 60 and 62 (see FIGS. 4 and 5) and abut the ends 66 and 68 of the slots to initially retain the casing 32 on the male connector member 14. The latching flap 34 is then pivoted about the living hinge 42 from the FIG. 6 position to the FIG. 7 position so as to cause detents 100 and 98 (see FIG. 5) to latch beneath the spring arm 26 (see FIG. 8). Pall 112 rests on top of detent 22 and exerts a bias thereagainst when the latching flap 34 is in the position of FIGS. 3, 7 and 8. When the latching flap is closed, the ribs 92 and 94 (see FIG. 5) are juxtaposed with the free edge 27 of the spring arm 26 so as to provide an additional stop, minimizing movement of the casing to the left in FIG. 7. As is seen in FIG. 7, there may be a slight space 126 between the front edge 27 and the ribs 94 (and 921 to accommodate compression of the resilient seal 30 against the inside surface of end wall 36. A shoulder 128 on top of the latching flap 34 provides a finger or tool stop which is engaged when latching the flap.

The casing 32 may be initially completely latched to the male connector member 14 with the female connector member 12 disengaged as is shown in FIG. 1. The male and female connectors can then be joined by shoving the projection 16 of the male member 14 into the opening 18 of the female member 12 (see FIG. 2). The detent 22 on the female member 12 then slides through the space 96 between the ribs 92 and 94 and engages the leading end 27 of the spring arm 26, causing the spring arm and the latching flap 34 latched thereto to deflect so that the detent 22 is received in the slot 24 of spring arm 26.

In order to disconnect the female connector member 12 from the male connector member 14, the tab portion 90 of the flap 34 is engaged and urged to pivot upwardly away from the spring arm 26 so that the detents 98 and 100 snap out of engagement with the spring arm. Upon then also camming the spring arm 26 upwardly, the detent 22 can escape from the slot 24 upon sliding the female connector member 12 axially away from the male connector member 14.

The casing 32 provides connector position assurance with minimal assembly parts and improves connector performance by enhancing reliability.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A casing for ensuring an electrical connection between a female electrical connector member and a male electrical connector member which are axially slid into connective engagement with one another, wherein said male electrical connector member has laterally extending detents and a cantilevered spring arm with a longitudinally extending slot for receiving a detent on the female electrical connector member, the casing comprising:

an end wall with an opening therein for alignment with an axially compressible seal having lead holes therethrough positioned at one end of the male member, the opening having an area smaller than the lateral area of the seal and aligning with the holes through the seal;

a pair of resilient side walls integral with the end wall, the side walls having longitudinally extending slots for receiving the detents on the male connector member to secure the casing to the male connector member;

a stiffened top wall unitary with the end wall and extending transversely with respect to the side walls, the top wall being positioned to engage the spring arm of the male member; and a latching flap connected to the top wall which is pivotable by a living hinge, the latching flap having detents for latchably engaging the spring arm on the male member to further secure the casing to the male member.

2. The casing of claim 1, wherein the detents of the latching flap are disposed on opposite sides of the latching flap in opposed relation with respect to one another and wherein the latching flap includes at least one rib for engaging a free laterally extending edge of the spring arm on the male member.

3. The casing of claim 1, wherein the latching flap includes a biasing pawl engageable by the detent on the female member when the female member is latched to the male member.

4. The casing of claim 3 including a stiffened bottom wall disposed in spaced relation with respect to the top wall and side walls.

5. The casing of claim 4, wherein the bottom and top walls are stiffened by portions which extend outwardly from the end wall.

6. The casing of claim 5, wherein the top wall further includes a longitudinally extending rib which is receivable in a slot in the spring arm of the male member, which said slot also receives the detent of the female member.

7. In combination, a female electrical connector member having a first body, an axial opening therein and a detent projecting laterally on said first body; a male electrical connector member having a second body, an axial projection thereon for receipt in the axial opening of the female member and a circumferential radial seal disposed around the axial projection, the male electrical connector member further having a pair of laterally projecting detents positioned on said second body and extending in opposite directions substantially normal to the detent on the female member and a cantilevered spring arm member extending longitudinally with respect to said second body and having a slot therein for receiving the laterally projecting detent on the female member, the male and female members, when in engagement, being covered by a casing having an end wall with an opening therethrough, a resilient seal positioned in the male member and aligned with said opening of said end wall, a pair of opposed spring arm side walls with slots therein for receiving a pair of lateral detents of the male member, and a latching flap having detents thereon for latchably engaging the cantilever spring arm member of the male member.

8. The combination of claim 7, wherein the casing further includes stiffened top wall, bottom wall and a latching flap, said latching flap being attached to the top wall by a living hinge.

9. The combination of claim 7, wherein the casing includes a depending rib portion having a surface for axially engaging a leading edge surface of the spring arm on the male member.

10. The combination of claim 9, wherein the latching flap further includes a resilient pawl for engaging the detent of the female member when the female member is latched to the male member.

* * * * *